US005601050A

United States Patent [19]

Erskine et al.

[11] Patent Number: 5,601,050

[45] Date of Patent: Feb. 11, 1997

[54] SECTIONAL WINDSHIELD SYSTEM FOR BOATS

[75] Inventors: Edward J. Erskine, Northville; Andrew Furlong, Gloversville, both of N.Y.

[73] Assignee: N.A. Taylor Co., Inc., Gloversville, N.Y.

[21] Appl. No.: 520,879

[22] Filed: Aug. 30, 1995

[51] Int. Cl.[6] ..... B63B 17/00

[52] U.S. Cl. ..... 114/361

[58] Field of Search ..... 114/361, 343; 296/84.1, 180.1; 135/87, 88

[56] References Cited

U.S. PATENT DOCUMENTS 3,093,844 6/1963 Brock et al. ..... 114/361

3,304,657 2/1967 Singleton ..... 114/361

3,654,648 4/1972 Wilhoit ..... 114/361

5,203,277 4/1993 Norman ..... 114/361

*Primary Examiner*—Stephen Avila

*Attorney, Agent, or Firm*—Nixon & Vanderhye

[57] ABSTRACT

Sections for the windshield of a boat are provided with each section having a transparent material with a continuous frame about the section including a bottom rail, a sub-top and verticals along opposite side edges. The sections may be manufactured and shipped in their sectional configuration and assembled on the boat with the verticals joining adjacent sections. To simulate the appearance of a unitary windshield, a top rail overlies aligned sub-tops. Seals are provided along the front and rear portions of the joint between the top rail and the sub-tops.

6 Claims, 4 Drawing Sheets

SECTIONAL WINDSHIELD SYSTEM FOR BOATS

TECHNICAL FIELD

The present invention relates to windshields for boats and particularly relates to sectional windshields assembled on the boat with a top rail whereby the installed windshield simulates a unitary boat windshield.

BACKGROUND

Windshields for boats are sometimes built as unitary structures at a manufacturing site and transported to a boat building site for installation on the boat. The windshields typically include port and starboard side panels and curved fronts, all having a rake or angle relative to the vertical. The complexity of the windshield indicates its manufacture at a site remote from the boat building site for later installation as a unit on the boat. Unitary windshield structures of this type are typically and desirably quite strong. However, a principle drawback of unitary windshields of this type is the necessity to transport the rather large cumbersome structure to the boat building site. Handling, shipping, storage and packaging create major problems in connection with these large unitary boat windshields. Further, it is oftentimes difficult to obtain effective sealing about the windshield particularly along the top of the windshield.

DISCLOSURE OF THE INVENTION

According to the present invention, there is provided a sectional windshield for a boat which is provided in discrete sections, each much smaller in size than a unitary boat windshield. These sections are later assembled on the boat affording an appearance of a unitary boat windshield. It will be appreciated that the problems associated with shipping, handling, packaging and storing large boat windshields are minimized or eliminated when windshield sections can be manufactured and shipped in much smaller packages to a boat building site. Also, the sections can be readily and easily installed on the boat with the final assembly resulting in the appearance of a unitary windshield. To accomplish the foregoing, the boat windshield is divided into a plurality of windshield sections. For example, for a small boat, five windshield sections may be provided, namely port and starboard wings, port and starboard curved fronts and a flat front in the middle. Each section comprises a transparent material, such as glass, bounded by a frame. For example, where the section has four sides, each windshield section may be bounded along its sides by one of male or female vertical frames and at the top and bottom by a sub-top and a bottom rail, respectively, carrying gaskets mounting the top and bottom edges of the transparent material.

Consequently, each windshield section is manufactured with the frame applied thereto at the manufacturing site. The sections can then be shipped individually and much more readily because of their smaller size and weight and shipping, handling, packaging and storing does not pose the significant problems posed by shipping unitary windshields as in the past. At the boat installation site, the individual windshield sections can be assembled to form the entire windshield of the boat. For example, the bottom rails may be screwed to the frame of the boat and the side verticals interlocked one with the other, i.e., a male member fitting within the female member with a silicone adhesive therebetween. Once the sections are assembled on the boat in proper alignment, it will be appreciated that a top rail can be superposed over adjoining sections spanning the sub-tops thereof and completely overlapping the joints along the sub-tops between sections. The top rail may be a unitary piece spanning the entirety of the periphery of the windshield or itself may be sectional provided it spans two or more of the windshield sections. For example, two mirror image top rails may be provided for spanning the wings curved fronts and portions of the flat front along respective opposite sides of the boat.

To join the top rail to the assembled sections, the sub-tops are uniquely formed to provide along one side a projecting locking flange coextensive in length with the sub-top. The top rail has an inverted generally U-shaped or channel-shaped cross-sectional configuration with depending spaced side flanges. One of the side flanges has a locking flange projecting toward the opposite side flange and which locking flange cooperates with the locking flange at the sub-top when the top rail is applied to the sub-top. The side flanges of the top rail are spaced from one another a distance in excess of the corresponding dimension of the sub-tops such that upon application of the top rail over the aligned sub-tops, the top rail can receive within the channel the aligned sub-tops. The top rail can then be displaced laterally to register the projecting flange of one side with the locking flanges of the sub-tops. Preferably a foam cord is disposed between the cooperating locking flanges of the sub-tops and the top rail to seal the top rail to the sub-tops. Along the opposite side flange of the top rail, there is provided an elongated resilient locking member, preferably formed of vinyl, and which has barbs for engaging in corresponding recesses in the top rail and sub-tops. Upon application of the elongated locking strip and its resilient deformation, the top rail is locked to the sub-tops with the locking flanges bearing in sealing relation to the foam cord seal. By overlying the sub-tops with a continuous top rail, and essentially enveloping the joints between the sections, the sectional windshield system hereof gives the appearance of a unitary windshield.

Accordingly, the present invention provides a sectional boat windshield system comprising a plurality of boat windshield sections, each having a transparent windshield surrounded by a frame including a bottom with at least one vertical on an end edge thereof and a sub-top, an elongated top rail for spanning adjoining windshield sections when assembled to form a boat windshield with the top rail overlying the sub-tops of adjoining windshield sections and spanning their full lengths, and a seal between the top rail and the sub-tops of adjoining windshield sections.

Accordingly, it is the primary object of the present invention to provide a novel and improved sectional windshield for boats simulating in final assembly the appearance of a unitary boat windshield and which sectional windshield affords improvements in sealing the windshield.

BEST MODE FOR CARRYING OUT THE INVENTION

Figure 1:
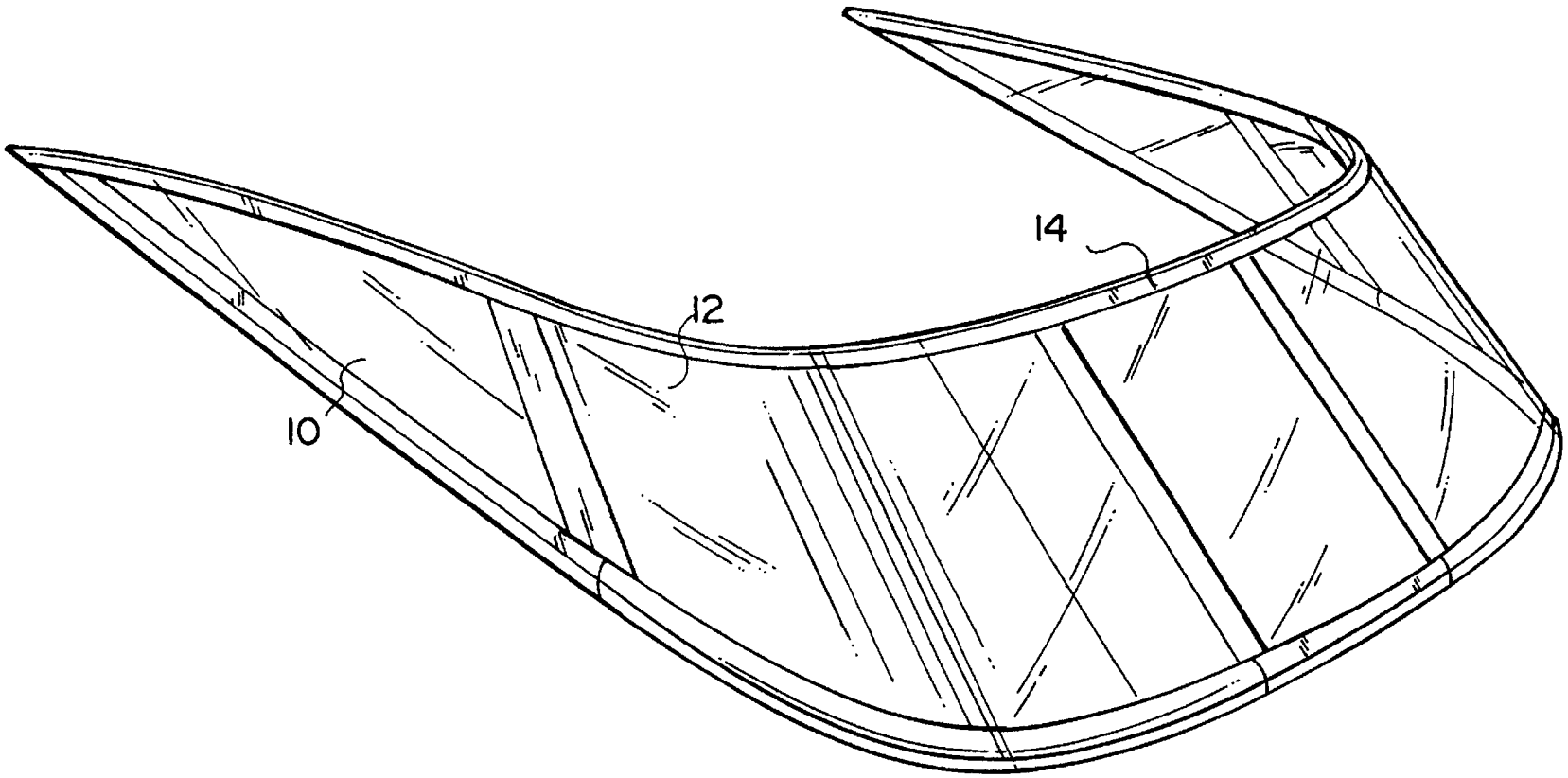
FIG. 1 is a perspective view of an exemplary sectional windshield for a boat according to the present invention.
Figure 2:
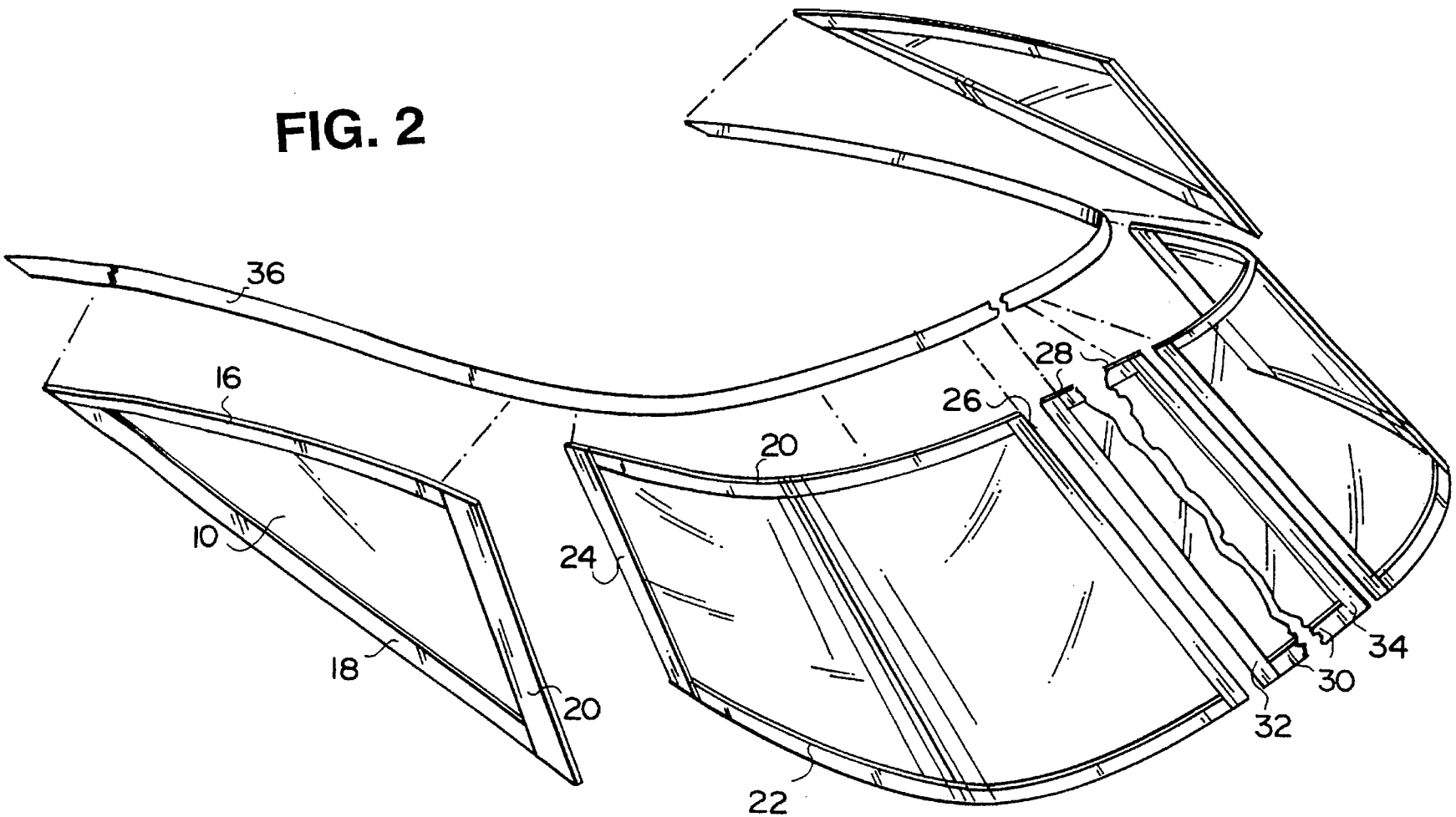
FIG. 2 is an exploded perspective view of the sectional windshield of FIG. 1.

Referring now to the drawings, particularly to FIG. 1, there is illustrated a sectional windshield constructed according to the present invention and comprising in this exemplary embodiment port and starboard wing sections 10, port and starboard curved fronts 12 and a flat front section 14. As illustrated in FIG. 2, each section 10, 12 and 14 is bounded by a frame. For example, the wing sections 10 are bounded by a sub-top 16, a bottom rail 18 and a vertical 20. Each of the curved front sections 12 is bounded by a sub-top 20, a bottom rail 22 and a pair of verticals 24 and 26 along opposite edges of those sections. The pressed front section is similarly bounded by a sub-top 28, a bottom rail 30 and a pair of verticals 32 and 34 along opposite sides.

In accordance with the present invention, the sections are prefabricated at a manufacturing site and shipped to a boat assembly site. It will be appreciated that the sections are considerably smaller in size and more readily and easily packaged, shipped, handled and stored, as compared with a unitary windshield, for example, of the same size as illustrated in FIG. 1 in the absence of the present invention. To simulate the appearance of a unitary windshield, the sectional windshields, once installed on the boat, are capped by a top rail which spans two or more of the sections along the sub-tops thereof. For example, as illustrated in FIG. 2, there is provided an elongated top rail 36 which is secured in overlying relation to the aligned sub-tops 16, 20 and 28 of the sections and sealed thereto. Note that the joints between the sections are effectively concealed by the integral top rail when disposed in overlying relation to the sub-tops of the sections. It will also be appreciated that the top rail 36 can be provided in two halves to facilitate its formation and shipping.

Figure 3:
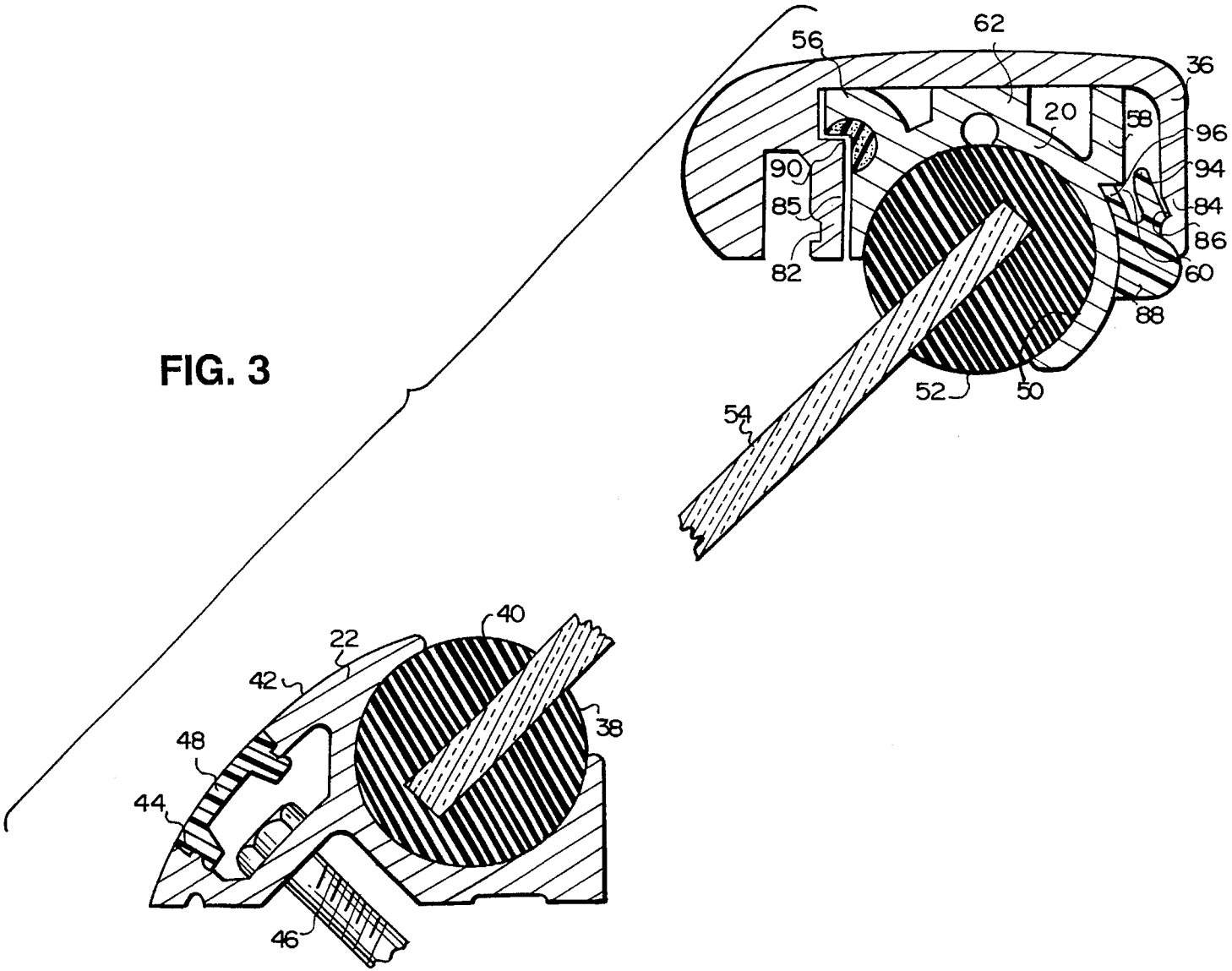
FIG. 3 is an enlarged cross-sectional view illustrating the top and bottom portions of the windshield sections with a top rail applied.

Referring now to FIG. 3, the bottom rail and sub-top for one of the sections illustrated in FIG. 2, together with the overlying top rail 36 are illustrated. The bottom rail, for example, rail 22, as are all rails and verticals of this invention, is formed of an aluminum extrusion. The bottom rail 22 includes an arcuate notch 38 opening in the general direction of the sub-top 20 for receiving a slotted generally circular gasket formed of a resilient material preferably EPDM rubber. The front side of the bottom rail 22 is curved at 42 and has a series of spaced openings 44 affording access to bolts or screws 46 for securing the bottom rail 22 and hence the window section to the boat. A cover 48 closes the opening 44.

The sub-top 20 includes an elongated aluminum extrusion having a downwardly and forwardly opening notch 50 for receiving a similar gasket 52. The gaskets, of course, mount the transparent material 54 between the bottom rail 22 and the sub-top 20. The sub-top 20 also includes a forwardly directed flange 56 constituting a locking flange for facilitating securement of the top rail 36 to the sub-top 20. Sub-top 20 also includes an upstanding flange 58 along its rear side mounting a depending elongated lip 60 for purposes described hereinafter. A central upwardly projecting flange 62 is mounted between the flanges 56 and 58. It will be appreciated that the transparent material 54 between the bottom rail 22 and the sub-top 20 may have a compound curve and that the bottom rail and sub-top are curved correspondingly to accommodate the compound curve.

Figure 4:
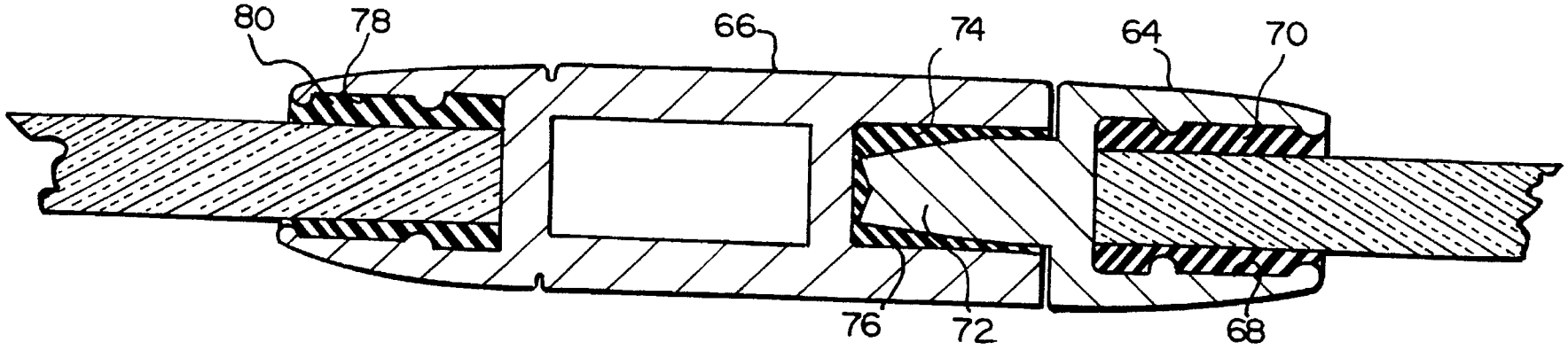
FIG. 4 is an enlarged cross-sectional view of the joined verticals along opposite sides of the sections of the windshield.

Referring now to FIG. 4, there is illustrated the verticals between the sections of the windshield. The verticals comprise male and female aluminum extrusions 64 and 66, respectively. The male part 64 has along an edge an elongated recess 68 for receiving the end margin of the glass and silicone adhesive 70 for securing and sealing the glass to the vertical. The male part 64 has a projection 72 along its edge which is received in a recess 74 formed on the female part 66, silicone adhesive 76 being provided between the male and female parts to secure and seal the male and female parts to one another. The opposite edge of the female part 66 has a similar opening 78 as the opening of the male part for receiving the end edge of the transparent material of an adjacent windshield section. Silicone adhesive 80 is likewise provided for securing and sealing the glass to the female part 66 which forms a portion of the windshield section adjacent the windshield section having the male part 70. It will be appreciated that the male and female parts 64 and 66, respectively, are glued to the respective sections at the manufacturing site and shipped to the boat building site for assembly. Consequently, when the sections are joined to one another along the sides during final assembly to form a completed windshield, the projection 72 is received in the receptacle 74 and silicone adhesive 76 is applied.

Referring back to FIG. 3, the top rail 36 is generally of an inverted U-shape or channel-shape having depending forward and rear ribs 82 and 84, respectively. The top rail is dimensioned such that the depending ribs 82 and 84 are spaced one from the other a distance in excess of the corresponding width of the sub-tops, e.g., 16, 20 and 28. The forward rib 82 has a locking flange 85 directed toward the opposite rib 84 for underlying the forwardly projecting locking flanges 56 of the sub-tops in final assembly. Between the two flanges 56 and 85, there is provided an elongated foam cord 90 which serves as a seal between the top rail 36 and the sub-tops 20.

To install the top rail over the aligned sub-tops of the various sections after the sections have been installed on the boat, the top rail 36 is disposed over the aligned sub-tops such that the depending ribs 82 and 84 straddle the sub-tops. Note that the rear rib 84 has an elongated indentation 86 along its inside face. To secure the top rail 36 to the aligned sub-tops, an elongated resilient member 88, preferably formed of vinyl, and coextensive with top rail 36 is disposed between the rear rib 84 of top rail 36 and the rear flange 58 of the sub-tops. The member 88 has tongues 94 and 96. Note that the tongue 94 has a rear projection for engaging in a recess 86 formed along the inner face of depending rib 84. By forcing the sealing strip between the rib 84 and flange 58 of the top rail and sub-tops, respectively, after the top rail has been positioned over the sub-tops, the top rail is biased in a direction causing the flange 82 to bear against the seal 90 with portions of the seal 90 between the locking flanges 56 and 85. At the same time, the bias locks the locking flanges to one another while the strip precludes disengagement of the top rail from the sub-tops along the flange 58 by the engagement of the rear projection on the strip in the recess 86. Thus, it will be appreciated that the top rail 36 spans the entire lengths of the sub-stops of two or more of the adjoining sections and the joints therebetween affording an appearance of a unitary boat windshield. Also, the arrangement of the seals between the top rail and the sub-tops is continuously effective to prevent leakage past the seals.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sectional boat windshield system comprising:

a plurality of boat windshield sections each having a transparent windshield surrounded by a frame including a bottom, at least one vertical on an end edge thereof and a sub-top;

an elongated top rail for spanning adjoining windshield sections when assembled to form a boat windshield with said top rail overlying the sub-tops of adjoining windshield sections and spanning their full lengths;

a seal between said top rail and said sub-tops of adjoining windshield sections;

said seal including an elongated resilient sealing strip between said sub-tops and said top rail;

an elongated resilient locking strip between said sub-tops and said top rail for locking the sub-tops and top rail to one another;

said sealing strip extending along one side of the windshield between said sub-tops and said top rail, said resilient locking strip extending along an opposite side of the windshield between said sub-tops and said top rail for biasing said top rail toward said sub-tops to compress said seal.

2. A sectional boat windshield system comprising:

a plurality of boat windshield sections each having a transparent windshield surrounded by a frame including a bottom, at least one vertical on an end edge thereof and a sub-top;

an elongated top rail for spanning adjoining windshield sections when assembled to form a boat windshield with said top rail overlying the sub-tops of adjoining windshield sections and spanning their full lengths; and a seal between said top rail and said sub-tops of adjoining windshield sections;

said top rail having a generally inverted channel-shaped cross-sectional configuration with opposed depending side ribs defining a recess therebetween for receiving said sub-tops and means for biasing said top rail against said seal.

3. A system according to claim 2 wherein said seal extends between one of the side ribs and said sub-tops, said biasing means including an elongated strip of resilient material extending between another of said side ribs and said sub-tops.

4. A sectional boat windshield system comprising:

a plurality of boat windshield sections each having a transparent windshield surrounded by a frame including a bottom, at least one vertical on an end edge thereof and a sub-top;

an elongated top rail for spanning adjoining windshield sections when assembled to form a boat windshield with said top rail overlying the sub-tops of adjoining windshield sections and spanning their full lengths;

a seal between said top rail and said sub-tops of adjoining windshield sections; and locking flanges on said sub-tops projecting to one side thereof, said top rail having a generally inverted channel-shaped cross-section with opposed depending side ribs defining a recess therebetween for receiving said sub-tops, one of said side ribs having a locking flange projecting toward another of said side ribs for locking engagement under the locking flanges of said sub-tops.

5. A system according to claim 4 wherein said seal is comprised of a resilient material.

6. A system according to claim 5 including a vinyl lock extending between said another rib of said top rail and said sub-tops.

* * * * *